United States Patent [19]

Raschle

[11] 4,040,244

[45] Aug. 9, 1977

[54] APPARATUS FOR FALSE-TWIST TEXTURING OF TEXTILE YARNS

[75] Inventor: Josef Raschle, Butschwil, Switzerland

[73] Assignee: Heberlein Maschinenfabrik AG, Switzerland

[21] Appl. No.: 710,418

[22] Filed: Aug. 2, 1976

[30] Foreign Application Priority Data

Aug. 19, 1975 Switzerland ..... 10793/75

[51] Int. Cl.[2] ..... D02G 1/04

[52] U.S. Cl. ..... 57/77.45; 57/105

[58] Field of Search ..... 57/77.3–77.45, 57/105, 92, 34 HS

[56] References Cited

U.S. PATENT DOCUMENTS

| | | | |
|---|---|---|---|
| 2,807,130 | 9/1957 | Trapido et al. | 57/77.45 X |
| 3,488,676 | 1/1970 | Bieniok | 57/77.45 |
| 3,631,665 | 1/1972 | Scriver et al. | 57/77.45 |
| 3,827,229 | 8/1974 | Bieniok | 57/77.45 |

*Primary Examiner*—John Petrakes

*Attorney, Agent, or Firm*—Larson, Taylor and Hinds

[57] ABSTRACT

A friction drive for a twist-tube for false-twist texturing of textile yarns is described wherein a continuously running belt rotates a pair of driving rolls, maintained at a constant pressure against the belt, to which rollers for rotating the twist tube are co-axially fixed. The driving rolls are carried at the end of a rod, mounted to slide through a fixed holder and subjected to an axial force by a weight hanging on a cord passing over a pulley having a fixed axis to a pin on the rod. The rolls are so mounted on the rod that they can be arranged to engage either face of the belt. Therefore, the force necessary to press the driving rolls against the belt is reversible. This is achieved by providing the rod with two pins, either of which can be chosen for attachment of the cord and from which the cord will hang in opposite directions over the pulley. This gravity mechanism can be replaced by fluid or electromagnetic means for exerting the force on the rod. In the latter event, a force measuring element measures the axial force on the rod and a resulting amplified signal is fed to a coil through which the rod projects, the rod being a magnet.

6 Claims, 4 Drawing Figures

APPARATUS FOR FALSE-TWIST TEXTURING OF TEXTILE YARNS

FIELD OF THE INVENTION

The present invention relates to an apparatus for false-twist texturing of textile yarns consisting of synthetic thermoplastic material.

DESCRIPTION OF THE PRIOR ART

False-twist devices are known which comprise twist tubes lying in wedge-shaped gaps between the rollers in pairs of axially parallel rollers in tangential contact with the rollers, the twist tubes being pressed against the rollers by means of magnets. In a known false-twist device of this kind, drive rolls provided on the shafts of the rollers are simultaneously applied by means of a spring against a common tangential driving belt which always travels in the same direction. Thereby, the twist tubes are driven practically without slipping and with a very constant revolution speed. This is not the case in devices in which only one of each pair of rollers in contact with the twist tube has a driving roll applied against the tangential belt. In that case the twist tube transmits the driving force between the driven roll and the non-driven roll effecting the simultaneous rotation thereof. This may cause considerable slipping and deviations of the required revolution speed, particularly at very high revolution speeds of the twist tube.

It has however been found that the known spring arrangements for pressing of the two driven rolls mounted on the shafts of the rollers have the disadvantage that the pressure force is subject to considerable deviations because of variations of elastic and plastic deformation of the belt which is due to ageing, climatic influences and vapours of chemicals as well as to the different positions of the rollers on the belt when imparting either S or Z false-twist. At the extremely high revolution speeds of the twist tube with which false-twist texturing machines are operated nowadays, this may lead to intolerable deviations from the required revolution speed.

Furthermore, false-twist devices for imparting false-twist in textile yarns by means of friction elements are known, for example devices consisting of two rotatable parallel axes on which there are disposed a number of circular discs, the rims of which overlap and project into spaces between the discs on the opposite axis. Also in devices of this kind, there is the problem of obtaining constant pressure of the rolls of the shafts of the two friction elements against the driving belt.

It is the purpose of the present invention to provide a device for use in twisting which avoids the aforesaid disadvantage and which assures a substantially constant pressure force between the rollers and the driving belt, independently of the conditions prevailing in the false-twisting operation.

Accordingly, the object of the present invention consists in a device for false-twist texturing textile yarns, comprising two axially parallel shafts rotatable about their axes, with rotation elements for driving twist tubes or for imparting friction false-twist, the two shafts being provided with driving rolls which are driven by means of a tangential belt, which is characterized by a rod mounted to slide in a bore in a holder rigidly connected with the machine frame, at one end of which rod is fixed a support for the shafts of the rotation elements and of the driving rolls as well as by means for creating a constant, adjustable thrust acting on the rod, which produces a corresponding pressure of the driving rolls against the belt.

DESCRIPTION OF THE DRAWINGS

Examples of the invention will hereinafter be described in more detail with reference to the accompanying drawings, in which:

Referring to FIGS. 1 and 2, a holder plate 2 is fixed to a machine frame 1 by means of screws 3, 3'. The frame 1 serves to locate a number of similar false-twist devices, only one such device being shown in the drawings. The plate 2 is formed with a bore 4 in which a rod 5 can slide in the direction of double arrow B. At one end of the rod 5, there is fixed an angular holder 6 which is shaped to provide a horizontal support plate 6'. At the end of a vertical portion of holder 6, there is provided a guide element 7 with a groove 7' in which a pin 7'' slides for restraining the holder 6 against rotation.

The support plate 6' is formed with two bores 8, 8' through which shafts 9, 10 of two axially parallel rollers for supporting a twist tube pass. FIG. 1 shows one of these rollers and each consists of two discs 22, 23 and an intermediate spacing ring 24. On the shafts 9, 10, below the support plate 6', there are provided driving rolls 11, 12 over which a driving belt 13 runs. The belt 13 is furthermore guided over two guide rollers 14, 15 so that it follows a slightly sinuous path as shown by full lines in FIG. 2 when the rod 5 is in the position shown.

Figure 1:
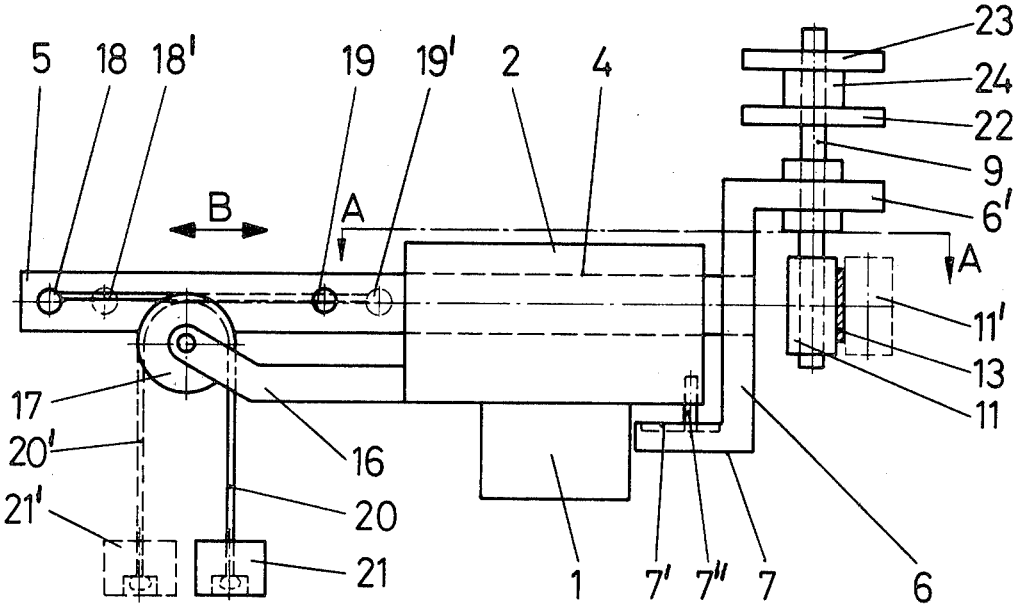
FIG. 1 shows in lateral elevation a device for use in false-twist texturing textile yarns.

On the holder plate 2, there is furthermore fixed a support arm 16 on the free end of which there is arranged for free rotation a roller 17 with a grooved rim. On the free end of rod 5, there are fixed two pins 18, 19 each of which is provided with a groove. A cord 20, which may be fixed to either of the pins 18, 19, passes over a pulley 17 and a weight 21 is fixed to its lower end. The weight 21 may consist of a basic weight and one or more additional weights which may be put thereon according to need. In an operative position of the rod 5, the pins 18, 19 are situated on opposite sides of the pulley 17. The cord 20, depending on the direction in which the rod 5 is to be loaded is fixed to the appropriate one of the pins 18, 19 and hangs over the pulley 17 in the required sense to keep the rolls 11, 12 firmly pressed against the driving belt 13.

Figure 2:
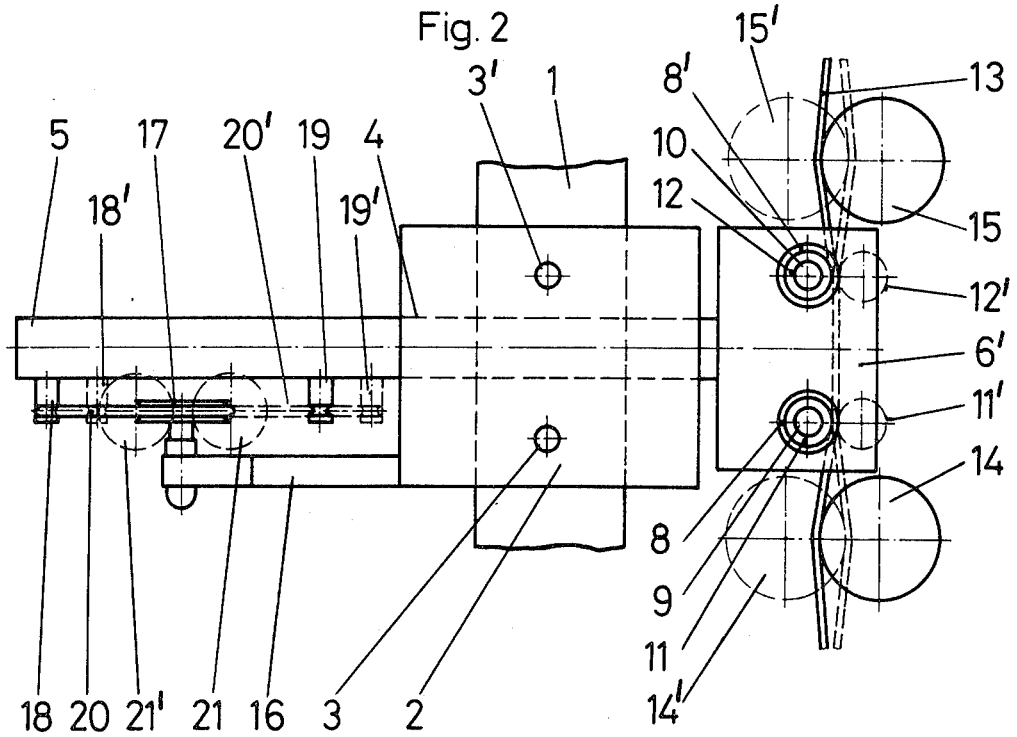
FIG. 2 shows a section of the device of FIG. 1 along line A—A in FIG. 1.

The positioning of the driving rolls 11, 12 and the belt 13 represented in FIGS. 1 and 2 by full lines, with the driving rollers pressing against the belt, results from cord 20 with weight 21 being fixed on pin 18 (also as shown by full lines).

For changing the direction of rotation of the twist tubes while the direction of movement of the belt remains the same, the driving rolls 11, 12 can be brought into the positions (11', 12') shown by broken lines. In this case, the free end of the cord is fixed on the pin 19 which is now in position 19', and the string 20 and the weight 21 now assume the positions 20', 21'. To provide the required slightly sinuous path of the belt 13, shown by broken lines, the rollers 14, 15 are moved to the positions 14' and 15'.

Instead of effecting the pressing of the driving rolls 11, 12 against the driving belt 13 by means of the pull of a weight, pneumatic or hydraulic means can be used.

Figure 3:
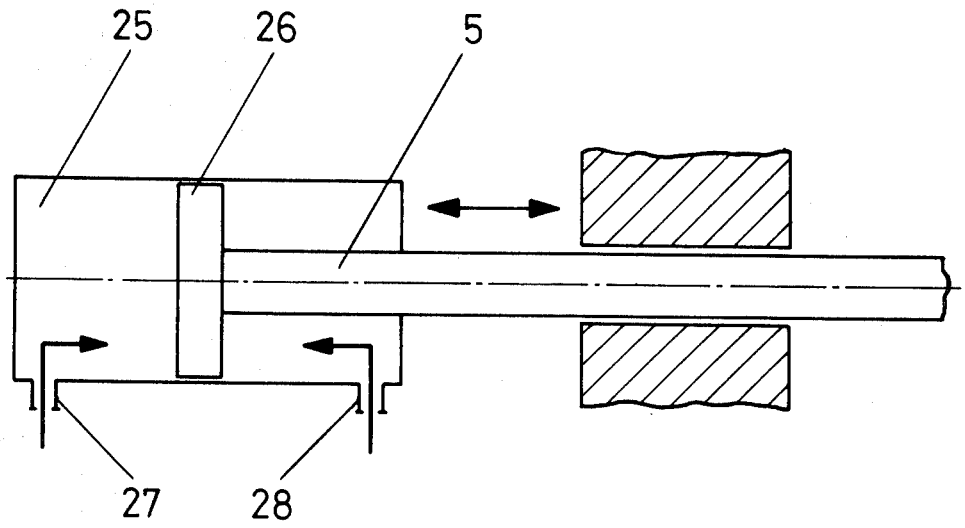
FIGS. 3 and 4 are diagrammatic lateral elevations of two further devices for use in false-twist texturing textile yarns.

As shown in FIG. 3, for example, at the free end of rod 5, there is fixed a piston 26 reciprocatable in a cylinder 25, which is actuated selectively by compressed air or by another gaseous or liquid medium fed through a selected one of pipe connections 27, 28.

Figure 4:
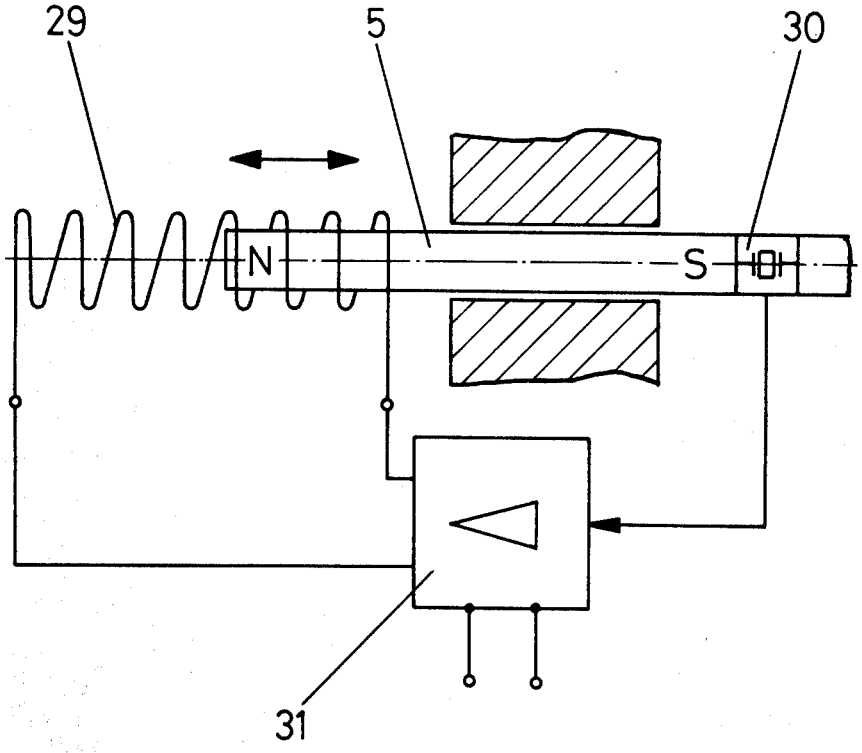

Furthermore, pressing of the driving rolls 11, 12 against the belt 13 is possible by electromagnetic means as shown in FIG. 4. On a rod 5 of permanently magnetized material, there is fixed a load sending element, for example a quartz load measuring cell 30 which is connected with the input of amplifier 31. A magnetic coil 29 wound around the free end of the rod 5 is connected with the output of amplifier 31. The cell 30 senses the magnitude and direction of the axial pressure on the rod due to the coil 29 at one end and the belt 13 at the other end and controls the magnitude and direction of the current passing through the coil to maintain the required pressure.

The device of the present application has various advantages. It above all provides an adjustable pressure of the driving rolls against the driving belt, which is independent of the position of these rolls on the belt and/or deflection of the belt, and the value of the adjusted pressure remains constant. Thereby, also at extremely high revolution speeds of the rotation elements, slippage between the belt and the driving rolls and variations of the revolution speed are avoided to a great extent. Furthermore, the device of the present invention offers a simplification of operation during starting the texturing operation, the pressure force of the rolls on the bolt being variable by increasing amounts for example by addition of supplementary weights to the basic weight.

The device is used for false-twist devices in which the wedge-shaped gap between the two parallel rollers (22, 23, 24) supports a twist tube in tangential contact therebetween so as to drive the twist tube at high speed. Alternatively, friction elements for imparting false-twist in textile yarns may be driven by the device.

I claim:

1. In apparatus for the false-twist texturing of textile yarns, a driving belt mounted to travel along a predetermined path during the operation of the machine, a fixed holder element formed with a guide passage, a rod guided in said passage so as to be slidable in opposite axial directions therethrough, said passage and rod being positioned so that one end of said rod is presented towards said belt, a support member fixed to said end of said rod and formed with two axially parallel bores extending therethrough in a plane to which said rod is perpendicular, two shafts respectively extending through and being rotatably mounted in said bores, driving rolls respectively mounted on said shafts in positions so to be driven by said belt when said rod is pulled in a direction to force said rolls against said belt, two rotation elements respectively mounted on said shafts for imparting rotation to means for false-twisting textile yarns, and means for imparting a constant, adjustable force to said rod to maintain a corresponding constant pressure between said rolls and said belt.

2. Apparatus according to claim 1, in which said means for imparting a constant force on said rod comprise an arm rigidly mounted on said holder element, a pulley mounted to rotate freely on said arm, said pulley being located in a vertical plane, an elongated, flexible element, means securing said flexible element to said rod, said pulley being positioned so that said flexible element extends in the direction of said pulley from said securing means, then over said pulley and then downwards, and a weight attached to the end of said flexible element.

3. Apparatus according to claim 2, including second means for securing said elongated, flexible element to said rod, said second securing means being positioned so that said flexible element extends in a direction opposite to said first mentioned direction over said pulley, whereby either said securing means can be selected according to the direction in which said weight is required to pull said rod, said support member being formed to locate said rolls in contact with either face of said belt as selected.

4. Apparatus according to claim 1, in which said means for imparting a constant force on said rod comprise a cylinder mounted coaxially with said rod with the end of said rod remote from said belt projecting into said cylinder, and means sealing opposite ends of said cylinder and formed with ports for the admission and exhaust of fluid pressure for holding said piston at a selected one of the ends of said cylinder.

5. Apparatus according to claim 1, in which said means for imparting a constant force on said rod comprises electromagnetic means arranged to exert a constant force on said rod.

6. Apparatus according to claim 5, in which said electromagnetic means comprises a force measuring element for responding to axial force transmitted through said rod and for transmitting an electrical signal corresponding to such force, a coil through which said rod extends, said coil being arranged to exert an axial electromagnetic force on said rod, an electrical amplifier, and conductors for carrying said electrical signal to said amplifier and for carrying said signal, when amplified, from said amplifier to said coil.

* * * * *